US005106071A

United States Patent [19]

Graham

[11] Patent Number: 5,106,071

[45] Date of Patent: Apr. 21, 1992

[54] DRAG CLUTCH DOCUMENT FEEDER MECHANISM

[75] Inventor: John F. Graham, Edinburgh, Scotland

[73] Assignee: Unisys Corporation, Blue Bell, Pa.

[21] Appl. No.: 497,430

[22] Filed: Mar. 22, 1990

[30] Foreign Application Priority Data

Jun. 2, 1989 [GB] United Kingdom ..... 8912711

[51] Int. Cl.[5] ..... B65H 3/06

[52] U.S. Cl. ..... 271/116; 271/122; 271/274

[58] Field of Search ..... 271/116, 122, 272, 273, 271/274

[56] References Cited

U.S. PATENT DOCUMENTS

| | | | |
|---|---|---|---|
| 3,556,512 | 1/1971 | Fackler | 271/122 X |
| 3,754,754 | 8/1973 | Peterson | 271/122 |
| 4,368,881 | 1/1983 | Landa | 271/122 |
| 4,515,358 | 5/1985 | Fukui | 271/122 |
| 4,674,735 | 6/1987 | DuBois et al. | 271/122 X |
| 4,709,911 | 12/1987 | Saiki et al. | 271/122 X |

FOREIGN PATENT DOCUMENTS

| | | | |
|---|---|---|---|
| 357012 | 3/1990 | European Pat. Off. | 271/122 |
| 149928 | 11/1981 | Japan | 271/122 |
| 42435 | 3/1982 | Japan | 271/122 |
| 98445 | 6/1982 | Japan | 271/122 |
| 6854 | 1/1983 | Japan | 271/122 |
| 188248 | 9/1985 | Japan | 271/122 |
| 218342 | 9/1987 | Japan | 271/122 |

*Primary Examiner*—Robert P. Olszewski
*Assistant Examiner*—Boris Milef
*Attorney, Agent, or Firm*—Whitham & Marhoefer

[57] ABSTRACT

A document feed system is disclosed which comprises a feed wheel (10) mounted on a first rotatable shaft (13), and a retard wheel (11) mounted on a second rotatable shaft (14). The first shaft is driven by a motor and the second shaft is mounted in a bearing fixed in a pivoting arm. A first pulley (17) is fixed on the first shaft and a second pulley (19) is coupled to the second shaft through a slipping clutch (18). A belt (20) passes round the first and second pulleys and also round an idler pulley (21) which is rotatable on a spring loaded shaft (22). The arrangement is such that the belt (20) pulls the first and second shafts towards each other so that a document may be gripped between the feed and retard wheels. If a single document is located in the nip between the feed and retard wheels it will be driven in the direction of the arrow (24). However, if two documents are located side by side in the nip, one document will be driven in the direction of the arrow (24) while the other is retarded relative to that document.

6 Claims, 3 Drawing Sheets

DRAG CLUTCH DOCUMENT FEEDER MECHANISM

BACKGROUND OF THE INVENTION

1. Field of the Invention

This invention relates to document feed systems and is particularly concerned with apparatus for moving documents in succession along a document track.

Document tracks are used, for example, in document encoding and sorting machines, in particular in check encoding machines. They are also used for moving mail, bank notes and other thin planar items.

2. Description of the Prior Art

Most document feed systems are liable to malfunction if two or more documents are fed along the track together. Accordingly means are normally provided to detect when more than one document is located in a particular position along the track. For example, it is known in the prior art to provide pneumatic suction along both sides of a track. A single document is attracted to a suction nozzle on only one side of the track, whereas multiple documents are attracted to suction nozzles on both sides of the track. While such a system enables multiple documents to be detected, it is relatively complicated and expensive.

Other known multiple document detection systems include light sensors. Such optical systems are not always satisfactory if the opacity of the documents varies, and in many cases cannot detect multiple documents when the leading edges of the documents are exactly aligned.

SUMMARY OF THE INVENTION

It has therefore been proposed to provide a system for separating multiple documents in which the documents are driven along the track between a feed wheel and a retard wheel. The coefficient of friction between each of said wheels and a document is greater than the coefficient of friction between two documents. As a result, if the retard wheel is designed to provide a braking force to a document in the track, or actually to provide a force tending to move a document in the opposite direction along the track compared with the feed wheel, multiple documents can be caused to slide with respect to one another. Thus it can be arranged that one pair of multiple documents is driven forwardly along the track while the other is either retarded or actually moved in reverse along the track until the first document has passed completely between the two wheels.

It is an object of the present invention to provide an improved method of implementing a system of the kind referred to in the preceding paragraph.

Thus the invention relates to a document feed system comprising a feed wheel mounted on a first rotatable shaft and a retard wheel mounted on a second rotatable shaft, said first and second shafts being mounted in bearings so that they are maintained parallel to one another, but can be moved towards, and away from, one another.

In accordance with the invention a first pulley is mounted on said first shaft and a second pulley is coupled to said second shaft through a slipping clutch, said first and second pulleys being interconnected by a drive belt arranged so that, if said feed wheel and said retard wheel are spaced apart, both wheels rotate in the same direction. The first pulley is driven and the arrangement is such that the belt pulls the first and second shafts towards each other so that a document is gripped between said feed and retard wheels and is moved in the direction determined by the rotation of the feed wheel, said retard wheel being caused by friction between said document and said retard wheel to rotate in the opposite direction to said feed wheel against the torque applied thereto through said slipping clutch.

It will be understood that in a feed system in accordance with the invention, if two documents enter the nip between the feed and retard wheels together, the torque applied to the retard wheel through the slipping clutch will cause the document with which the retard wheel is in contact to move relative to the document which is being driven along the track by the feed wheel. This may either cause the unwanted document to move in the reverse direction along the track or may merely hold it stationary between the feed and retard wheels until the other document is clear of the nip between the two wheels.

In a system in accordance with the invention it is of course necessary that the coefficient of friction between each of the feed and retard wheels and a document is greater than the coefficient of friction between two documents. However, the coefficient of friction between the feed wheel and a document may be the same as the coefficient of friction between the retard wheel and the document so that in principle the same components can be used for both wheels.

Preferably the bearing for the second rotatable shaft is mounted on a pivot so that the second shaft can be moved towards, and away from, the first shaft by swinging about the pivot axis. Preferably also the belt passes around a third pulley and this third pulley is mounted is such a way that it can be used to increase the tension in the belt.

As already stated, when the feed wheel is driven in the direction to move a document along the track, the belt rotates the retard wheel in the same direction so that the peripheries of the two wheels on opposite sides of the nip are moving in opposite directions. Provided the initial nip force between the wheels is great enough, however, the slipping clutch slips and allows the retard wheel to be driven by the feed wheel. The tension in the drive belt increases in order to overcome the slipping clutch torque and this increased tension results in an increased nip force between the feed and retard wheels. It will be shown hereinafter that the nip force required between the feed and retard wheels for correct operation of the system is directly related to the value of the slipping clutch torque. The mechanism is arranged so that the tension in the belt necessary to drive the slipping clutch is used to apply the required nip force between the feed and retard wheels. The system therefore automatically adjusts the nip force according to any variation in drag torque. Some advantages of the invention are that it is relatively simple and works at low levels of nip force. This could mean that the life of the feed and retard wheels is greater than it would be in other proposed systems.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
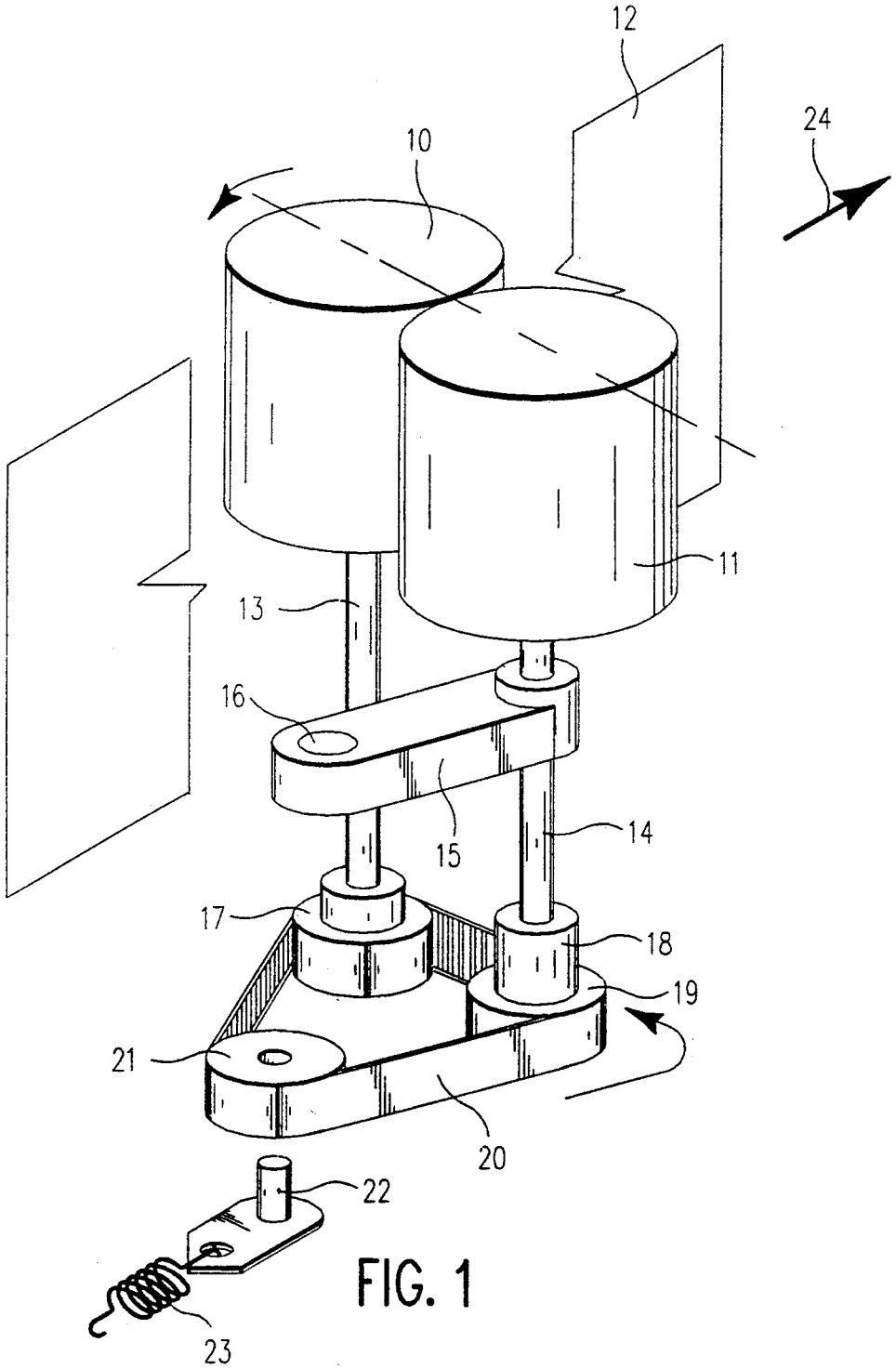
FIG. 1 illustrates an embodiment of the invention.

The document feeder mechanism illustrated in FIG. 1 includes a feed wheel 10 and a retard wheel 11. These wheels are located one on each side of a document path and serve to feed documents along the path. One such document is shown at 12. Both wheels are made of, or covered with, a relatively dense rubber.

The feed wheel is mounted on a rotatable shaft 13 and the retard wheel is mounted on a rotatable shaft 14. The feed wheel shaft 13 is mounted in bearings secured in the mechanism while the shaft 14 is mounted in bearings secured to a pivoting arm 15. The arm 15 is pivotable about an axis indicated at 16 which is fixed in the mechanism.

Mounted on he lower end of the shaft 13 is a drive pulley 17, and mounted on the lower end of the shaft 14 is a slipping clutch 18. The input to the slipping clutch is received from a pulley 19 A belt 20 passes around the pulleys 17 and 19 and around an idler pulley 21. The idler pulley is rotatable on a shaft 22 to which tension is applied by means of a spring 23. The end of the spring remote from the shaft 22 is fixed in the mechanism.

Means (not shown) are provided to drive the pulley 17. This drive is transmitted through the belt 20 to the pulley 19 so that the two pulleys 17 and 19 are both rotated in an anticlockwise direction. The tension in the belt 20 causes the arm 15 to rotate in an anticlockwise direction so that the feed and retard wheels 10 and 11 are urged towards each other to form a nip in the document path. The torque applied to the shaft 14 through the slipping clutch 18 tends to rotate the retard wheel 11 in an anticlockwise direction, but the friction between the peripheries of the two wheels 10 and 11 causes the wheel 11 to rotate in a clockwise direction when there is no document in the nip. When there is a single document in the nip, the retard wheel 11 is still caused to rotate in a clockwise direction by the friction between the document and the retard wheel 11 as the document travels in the direction indicated by the arrow 24.

If two documents enter the nip side by side, the document nearer to the feed wheel 10 will still be driven in the direction of the arrow 24 by the friction between it and the periphery of the feed wheel 10. However, the arrangement is such that the document nearer to the retard wheel 11 and the document is greater than the coefficient of friction between the two documents. The torque applied to the retard wheel 11 through the slipping clutch 18 may be such that the document nearer to the retard wheel 11 is actually moved in the reverse direction along the path, in which case, of course, the retard wheel 11 rotates in an anticlockwise direction. Alternatively the arrangement may be such that the feed wheel 11 merely holds the second document stationary until the first document has cleared the nip.

It is to be understood that when the clutch 18 slips, the tension in the drive belt 20 increases in order to overcome the slipping clutch torque and this increased tension results in an increased nip force between the feed and retard wheels 10 and 11.

As will be shown hereinafter, the nip force required between the feed and retard wheels for correct operation of the system is directly related to the value of the slipping clutch torque. The mechanism is arranged so that the tension in the belt necessary to drive the slipping clutch is used to apply the required nip force between the wheels. The system therefore automatically adjusts the nip force according to any variation in the slipping clutch torque.

In the explanation of the theory of operation of the systems in accordance with the invention the following symbols are used:

R the radius of the feed and retard wheels

S the slipping clutch torque

F1 = the coefficient of friction between the surfaces of the feed and retard wheels.

F2 = the coefficient of friction between either wheel and a document

F3 = the coefficient of friction between two documents.

P = the total force between the feed and retard wheels.

r = the radius of the two pulleys 17 and 19.

T1 = the tension in the portion of the belt 20 between the two pulleys 17 and 19, and TO = the tension in the belt 20 between the pulley 17 and the idler pulley 21.

The condition which must be met for the feed wheel 10 to rotate the retard wheel clockwise with no document in the nip is:

$$F1 \times P \geqq S/R \text{ and therefore}$$

$$S \leqq F1 \times P \times R$$

The condition which must be met, when there is a single document in the nip, for the feed wheel 10 to move the document in the direction of the arrow 24, is:

$$F2 \times P \geqq S/R \text{ and therefore}$$

$$S \leqq F2 \times P \times R$$

The conditions which must be met, when there are two documents in the nip, for one document to be driven forward and for the second document to be retarded, are:

$$F2 \times P \geqq F3 \times P \text{ i.e. } F2 \geqq F3$$

and $$F3 \times P \leqq S/R \text{ i.e. } S \leqq F3 \times P \times R$$

Hence for correct operation:

$$F3 \times P \times R \leqq S \leqq F2 \times P \times R$$

Figure 2:
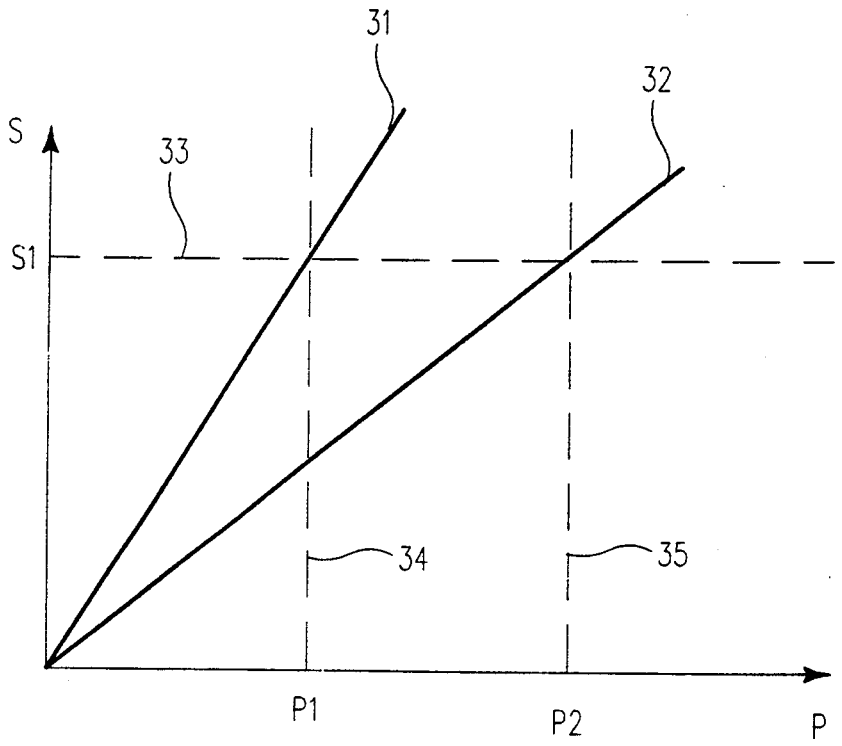
FIG. 2 is a graph showing variation of the drag torque with the nip force.

This condition is represented graphically in FIG. 2 in which the ordinates represent the force P. The line 31 shows how the value of the term $F2 \times P \times R$ varies with the torque S and the line 32 shows how the value of the term $F3 \times P \times R$ varies with S. If the torque has a value S1 indicated by the broken line 33, then for correct operation of the system the force P must lie between P1 and P2 as indicated by the broken lines 34 and 35 respectively. If the force is below the value P1, there will be no document feed, whereas, if the force is above the value P2, there will be no retardation of a second document.

Figure 3:
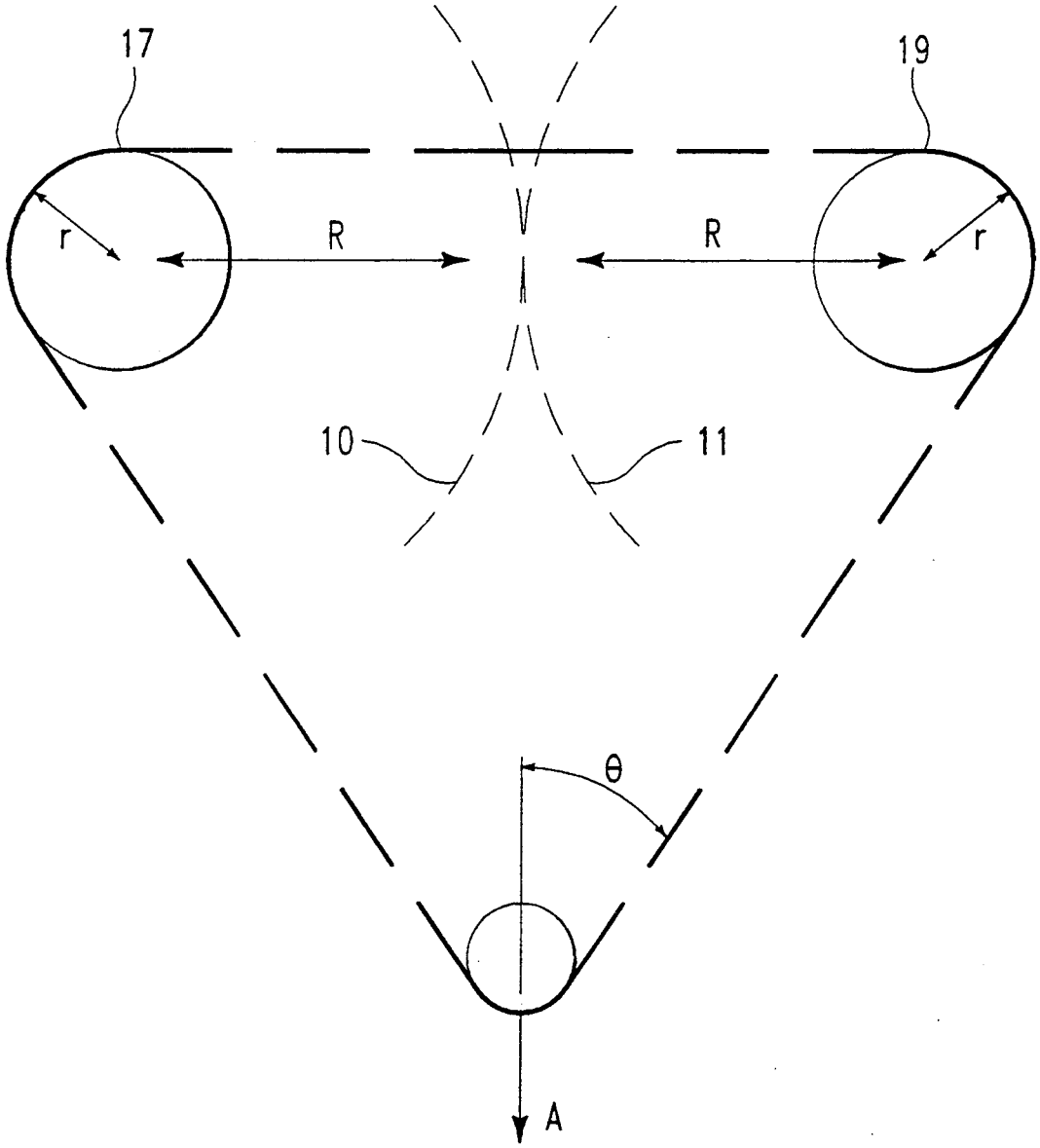
FIG. 3 is a schematic illustrating the geometry of invention.

An approximate calculation will now be given for the minimum initial belt tension necessary to produce correct operation. This tension TO will be provided by the spring 23. Referring to FIG. 3, it will be appreciated that TO is a function of the spring force (A) exerted by spring 23 and the angle $\theta$.When the pulley 17 is driven, the tension in the belt between the pulleys and 19 will be increased to T1 by the transmitted drive force, but the belt tension between the pulleys 17, 19 and the idler pulley 21 will remain TO. Thus the total force P, applied between the drive and retard wheels, will approximate to T1+TO Sin $\theta$. Therefore, the condition for driving a single document against the resistance of the retard wheel may be rewritten as $$F2\ (T1+TO\ \mathrm{Sin}\ \theta) \leqq S/R \text{ i.e. } T1+TO\ \mathrm{Sin}\ \theta \leqq SF2\times R \qquad (A)$$

The forces applied to the pulley 19 are T1 and TO, and, when the clutch 18 does not slip, the belt induced torque on the pulley 19 must equal the retarding torque from the wheel 11, i.e.

$$(T1-TO)r=F2\ (T1+TO\mathrm{Sin}\ \theta)\ R.$$

Therefore $$T1\times r-TO\times r=F2\times R\times T1+F2\times R\times TO\ \mathrm{Sin}\ \theta$$

and therefore $$T1(r-F2\times R)-TO(r+F2\times R\mathrm{Sin}\ \theta)=O \qquad (B)$$

$$\text{i.e. } T1-TO\ (r+F2\times R\mathrm{Sin}\ \theta)/(r-F2\times R)=O$$

If equation (A) is subtracted from equation (B), (to eliminate T1)

$$TO[(\mathrm{Sin}\ \theta+(r+F2\times R\ \mathrm{Sin}\ \theta)/(r-F2\times R)] \leqq SF2\times R$$

Hence the condition for the system to "selftighten" is:

$$TO>S/2\times R\ [\mathrm{Sin}\ \theta+(r+F2\times R\ \mathrm{Sin}\ \theta)/(r-F2\times R)]$$

When the clutch 18 is slipping, $$(T1-TO)r=S$$

i.e.

$$T1-TO=S/r \text{ and } T1=S/r+TO$$

As already stated, $$P=T1+TO\ \mathrm{Sin}\ \theta \text{ and therefore}$$

$$P=S/r+TO\ (1-\mathrm{Sin}\ \theta)$$

Hence the total force P varies directly with the torque S and therefore the system automatically adjusts the nip force according to any variation in the slipping clutch torque.

While the invention has been described in terms of a single preferred embodiment, those skilled in the art will recognize that the invention can be practiced with modification within the spirit and scope of the appended claims.

Having thus described my invention, what I claim as new and desire to secure by Letters Patent is as follows:

1. A document feed system comprising:

a feed wheel mounted on a first rotatable shaft;

a retard wheel mounted on a second rotatable shaft;

a bearing supporting said first rotatable shaft and a bearing supporting said second rotatable shaft so that said first and second rotatable shafts are maintained parallel to one another but can move towards, and away from, one another;

a first pulley mounted on said first shaft;

a second pulley coupled to said second shaft through a slipping clutch which slips when the torque applied thereto exceeds a predetermined value;

an idler pulley; 'a drive belt interconnecting said first pulley, said second pulley, and said idler pulley, said drive belt wrapped around said first and second pulleys so said belt exerts an unbalanced force on said first and second pulleys which force is a function of the torque exerted by said belt on said retard wheel;

means to drive said pulleys so that said belt pulls said first and second shafts towards each other so that a document gripped between said feed and retard wheels is moved in a direction determined by the rotation of said feed wheel and is gripped by a nip force determined by said predetermined value of slipping clutch torque; said retard wheel being caused by torque generated by friction between said document and said retard wheel to rotate in the opposite direction to said feed wheel against a torque applied thereto to said slipping clutch;

said torque applied to said retard wheel by friction between said retard wheel and a document dropping below said predetermined value of slipping clutch torque when two or more documents are gripped between said feed and retard wheels so that said nip force drops below the value established by said predetermined slipping clutch torque with one of said documents moved in a direction determined by the rotation of said feed wheel, and said retard wheel being caused by a torque exerted through said slipping clutch to rotate in the same direction as said feed wheel.

2. A system according to claim 1, wherein the coefficient of friction between the feed wheel and a document is substantially the same as the coefficient of friction between the retard wheel and the document.

3. A system according to claim 1, wherein the bearing for said second shaft is mounted on a pivot.

4. A system according to claim 1, wherein the slipping clutch torque and the belt tension are such that if two documents enter the nip between the feed and retard wheels side by side, the document nearer to the feed wheel will be driven in the direction determined by the direction of rotation of the feed wheel, whereas the document nearer to the retard wheel will not be advanced in the same direction as the first mentioned document.

5. A system according to claim 1, wherein the slipping clutch torque is equal to, or greater than, the product of the coefficient of friction between two documents, the total force between the feed and retard wheels, and the radius of the feed and retard wheels, and equal to, or less than, the product of the coefficient of friction between the feed and retard wheels, and the radius of the feed and retard wheels.

6. A document feed system according to claim 1, wherein said idler pulley is mounted on resilient means that applies an initial, adjustable tension on said drive belt.

* * * * *